US007203451B2

(12) United States Patent
Kayahara et al.

(10) Patent No.: US 7,203,451 B2
(45) Date of Patent: Apr. 10, 2007

(54) DEVELOPMENT ROLLER, DEVELOPMENT ROLLER BASE, DEVELOPMENT ROLLER MANUFACTURING METHOD, AND IMAGE FORMING APPARATUS

(75) Inventors: Yasufumi Kayahara, Iwatsuki (JP); Akitoshi Akaike, Iwatsuki (JP); Toshiaki Suzuki, Iwatsuki (JP); Atsuna Saiki, Iwatsuki (JP); Masahiro Ando, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 113 days.

(21) Appl. No.: 10/942,974

(22) Filed: Sep. 17, 2004

(65) Prior Publication Data

US 2005/0095039 A1 May 5, 2005

(30) Foreign Application Priority Data

Sep. 29, 2003 (JP) ..... 2003-337910

(51) Int. Cl.
*G03G 15/08* (2006.01)

(52) U.S. Cl. ..... 399/286

(58) Field of Classification Search ..... 399/103, 399/105, 222, 265, 279, 286
See application file for complete search history.

(56) References Cited

U.S. PATENT DOCUMENTS 5,105,226 A * 4/1992 Sugihara ..... 399/279 X
5,617,191 A * 4/1997 Murakami et al. ..... 399/286
5,970,294 A * 10/1999 Narita et al. ..... 399/286
6,070,037 A * 5/2000 Sugihara et al. ..... 399/103 X

FOREIGN PATENT DOCUMENTS

JP 05-011582 1/1993
KR 1999-015301 A 3/1999

* cited by examiner

*Primary Examiner*—Sandra I. Brase
(74) *Attorney, Agent, or Firm*—Sughrue Mion, PLLC

(57) ABSTRACT

The present invention provides a development roller disposed in proximity of a photosensitive body which is charged by a charging member and on which an electrostatic latent image is formed, the development roller performing development by transferring toner to the photosensitive body. The development roller includes a toner layer formation area where a toner layer is formed on a surface of a development roller main body portion and a small diameter portion which has a diameter smaller than that of the toner layer formation area and which is located in at least a part of an area where the toner layer is not formed on the surface of the development roller main body portion.

12 Claims, 13 Drawing Sheets

DRS AND LEAKAGE LIMIT ON DEVELOPMENT SIDE (ATMOSPHERIC PRESSURE AT WHICH BIAS LEAKAGE IS GENERATED)

DRS AND LEAKAGE LIMIT OF END PORTION (AREA a) (ATMOSPHERIC PRESSURE AT WHICH BIAS LEAKAGE IS GENERATED)

DEVELOPMENT ROLLER, DEVELOPMENT ROLLER BASE, DEVELOPMENT ROLLER MANUFACTURING METHOD, AND IMAGE FORMING APPARATUS

CROSS-REFERENCE TO RELATED APPLICATION

This application claims priority under 35 USC 119 from Japanese Patent Application No. 2003-337910, the disclosure of which is incorporated by reference herein.

BACKGROUND OF THE INVENTION

1. Field of the Invention

The invention relates to a development roller, a development roller base, a development roller manufacturing method, and an image forming apparatus.

2. Description of the Related Art

In an image forming apparatus in which a toner image is formed on a recording medium by the so-called electrostatic recording method, development (visualization) is performed by forming an electrostatic latent image with a laser beam from a light-beam scanning device to supply toner to the electrostatic latent image from a development roller while a photosensitive drum is charged by a charging device. The toner of the visualized image is transferred and fixed to the recording medium such as paper to obtain the desired image on the recording medium.

In the image forming apparatus having the above-described configuration, in order to obtain a high-quality image, it is desirable to narrow a gap between the photosensitive drum and the development roller (hereinafter, the gap is referred to as DRS). However, in this case, bias leakage (voltage leakage) tends to easily occur between the photosensitive drum and the development roller. The bias leakage easily occurs particularly when atmospheric pressure is low as in high altitude areas and the like. The bias leakage causes damage to the photosensitive drum and the development roller and a decrease in quality of the image on the recording medium. For example, it is conceivable that a method of decreasing development bias voltage is employed in order to prevent the voltage leakage. However, a good-quality image can not be obtained by this method due to the decrease in development efficiency.

A configuration in which bias leakage is eliminated by setting DRS and the development bias voltage to a predetermined range is described in Japanese Patent Application Laid-Open (JP-A) No. 5-11582.

However, in the configuration described in JP-A No. 5-11582, it is difficult to prevent the bias leakage when the atmospheric pressure is low as in high altitude areas, and the lower limit of DRS is restricted, so that there is a limitation to obtain a high-quality image by further narrowing DRS to increase the development efficiency.

SUMMARY OF THE INVENTION

In view of the foregoing, the present invention provides a development roller which can increase development efficiency to obtain a high-quality image while preventing bias leakage, a development roller base constituting the development roller, a method for manufacturing the development roller, and an image forming apparatus.

A first aspect of the invention is a development roller disposed in proximity of a photosensitive body which is charged by a charging member and on which an electrostatic latent image is formed, the development roller performing development by transferring toner to the photosensitive body, the development roller being configured so that at least a part of an area where the toner layer is not formed on the surface of the development roller is adapted to be a small diameter portion having a diameter smaller than that of a toner layer formation area where the toner layer is formed.

Generally, the bias leakage between the photosensitive body and the development roller is difficult to occur in the toner layer formation area where the toner layer is formed, and the bias leakage easily occurs in the area where the toner layer is not formed.

In the development roller of the first aspect, at least a part of the area where the toner layer is not formed is adapted to be the small diameter portion having the diameter smaller than that of the toner layer formation area, and DRS between the photosensitive body and the development roller is increased. Therefore, the bias leakage can be securely prevented in the small diameter portion. Further, since the toner layer formation area is not formed in the smaller diameter, DRS can be narrowed at the toner layer formation area, which allows the development efficiency to be increased to obtain a high-quality image.

A second aspect of the invention is a development roller disposed in proximity of a photosensitive body which is charged by a charging member and on which an electrostatic latent image is formed, the development roller performing development by transferring toner to the photosensitive body, the development roller being configured so that a coating layer on which a toner layer is formed is formed on the surface of a development roller base and a diameter of the development roller base corresponding to the area where the coating layer is not formed is smaller than that corresponding to the area where the coating layer is formed.

Namely, in the development roller, the portion where the bias leakage easily occurs is formed to be a non-coating area, and the generation of the bias leakage is prevented by decreasing the outer diameter of the development roller base in the non-coating area.

A third aspect of the invention is a development roller base of a development roller disposed in proximity of a photosensitive body which is charged by a charging member and on which an electrostatic latent image is formed, the development roller performing development by transferring toner to the photosensitive body, the development roller base being configured so that a base small diameter portion has a diameter smaller than that of other portions of the development roller base and is located in at least one end portion in an axial direction of the development roller base.

The above development roller can be manufactured by applying a development roller manufacturing method (dip coating technique) of a fourth aspect of the invention to the development roller base. Namely, a coating layer is formed on the development roller base by taking out the development roller base that is dipped into a coating solution from the coating solution so that the base small diameter portion is located on the lower side. At this point, even if the coating solution rises at a lower end of the development roller base by a drip of the surface of the development roller base, a tip end of the rising portion does not project toward the outside in a radial direction of the coating layer applied to the portion except for the small diameter portion of the development roller base.

When the convex portion locally exists in the coating layer, the bias leakage is generally easy to occur between the convex portion and the photosensitive body. However, in the development roller obtained by the above-described method, the generation of the bias leakage can be prevented.

A fifth aspect of the invention is a development roller manufactured by a dip coating technique, the development roller characterized in that a small diameter portion has a diameter smaller than that of a toner layer formation area where a toner layer is formed by thinning a film thickness on one end side corresponding to a lower side during the dip coating thinner than that of other portions.

In the development roller of the fifth aspect, even if the coating solution rises at the lower end of the development roller base by the drip of the surface of the development roller base, the tip end of the rising portion does not project toward the outside in a radial direction of the toner layer formation area by thinning the film thickness on the lower end side of the developing roller base when the coating layer is applied on the surface of the development roller base by the dip coating technique. When the convex portion locally exists in the coating layer, the bias leakage is generally easy to occur between the convex portion and the photosensitive body. However, in the development roller obtained by the above-described method, the generation of the bias leakage can be prevented.

A development roller of a sixth aspect of the invention has the development roller base of the third aspect and the coating layer which is applied to a surface of the development roller base by the dip coating technique, the coating layer including a small diameter portion having a diameter smaller than that of a toner layer formation area where a toner layer is formed by thinning a film thickness on one end side corresponding to a lower side during the dip coating thinner than that of other portions.

The coating layer having the small diameter portion is formed on the development roller base of the third aspect by the dip coating technique. Therefore, in the case where there is a limitation in the thickness of the development roller base, it is possible that the tip end of the rising portion does not project toward the outside in a radial direction of the toner layer formation area, even if the coating solution rises at the lower end of the development roller base by the drip on the surface of the development roller base.

An image forming apparatus of a seventh aspect of the invention includes a photosensitive body on which an electrostatic latent image is formed, a charging member which charges the photosensitive body, and a development roller as in any one of the first aspect, the second aspect, the fifth aspect, and the sixth aspect, which performs development by transferring toner to the photosensitive body charged by the charging member.

In the image forming apparatus, the electrostatic latent image is formed on the photosensitive body charged by the charging member, and the electrostatic latent image is developed (visualized) by transferring the toner from the development roller. The development roller as in any one of the first aspect, the second aspect, the fifth aspect, and the sixth aspect is used, so that the bias leakage can be securely prevented and the development efficiency can be increased to obtain a high-quality image.

An image forming apparatus of an eighth aspect of the invention includes a photosensitive body on which an electrostatic latent image is formed, a charging member which charges the photosensitive body, and a development roller which is manufactured by the development roller manufacturing method of the fourth aspect and which performs development by transferring toner to the photosensitive body charged by the charging member.

In the above image forming apparatus, the electrostatic latent image is formed on the photosensitive body charged by the charging member, and the electrostatic latent image is developed (visualized) by transferring the toner from the development roller. Since the development roller manufactured by the development roller manufacturing method of the fourth aspect is used, the bias leakage can be securely prevented and the development efficiency can be increased to obtain a high-quality image.

An image forming apparatus of ninth aspect of the invention includes a photosensitive body on which an electrostatic latent image is formed, a charging member which charges the photosensitive body, and a development roller which performs development by transferring toner to the photosensitive body charged by the charging member, wherein the development roller and the charging member are relatively positioned so that an uncoated layer portion where a coating layer is not formed on the development roller and the charging member overlap in an axial direction of the photosensitive body.

In the above image forming apparatus, the electrostatic latent image is formed on the photosensitive body charged by the charging member, and the electrostatic latent image is developed (visualized) by transferring the toner from the development roller. Even if the layer in which the bias leakage easily occurs is used as the coating layer formed on the surface of the development roller, the development roller and the charging member are relatively positioned so that the area of coating layer of the development roller is located inside the charging member of the photosensitive body, so that the bias leakage can be securely prevented and the development efficiency can be increased to obtain a high-quality image.

An image forming apparatus of a tenth aspect of the invention includes a photosensitive body on which an electrostatic latent image is formed, a charging member which charges the photosensitive body, a development roller which performs development by transferring toner to the photosensitive body charged by the charging member, and a seal member which is disposed near an end portion in an axial direction of the development roller while being in contact with the development roller, the seal member preventing the toner from moving outward in the axial direction, wherein the seal member and the charging member are relatively positioned so that the charging member is located outside the seal member in the axial direction of the photosensitive body.

In the above image forming apparatus, the electrostatic latent image is formed on the photosensitive body charged by the charging member, and the electrostatic latent image is developed (visualized) by transferring the toner from the development roller. The seal member is disposed in contact with the development roller and prevents the toner from moving outward in the axial direction. The development roller and the charging member are relatively positioned so that the charging member is located outside the seal member in the axial direction of the photosensitive body. Therefore, the bias leakage can be securely prevented and the development efficiency can be increased to obtain a high-quality image.

The invention has the above-described configurations, so that the bias leakage can be securely prevented and the development efficiency can be increased to obtain a high-quality image.

BRIEF DESCRIPTION OF THE DRAWINGS

Embodiments of the present invention will be described in detail based on the following figures, wherein:

FIG. 5B is a graph showing the relationship between DRS and the leakage limit in an area a;

DETAILED DESCRIPTION OF THE INVENTION

Figure 1:
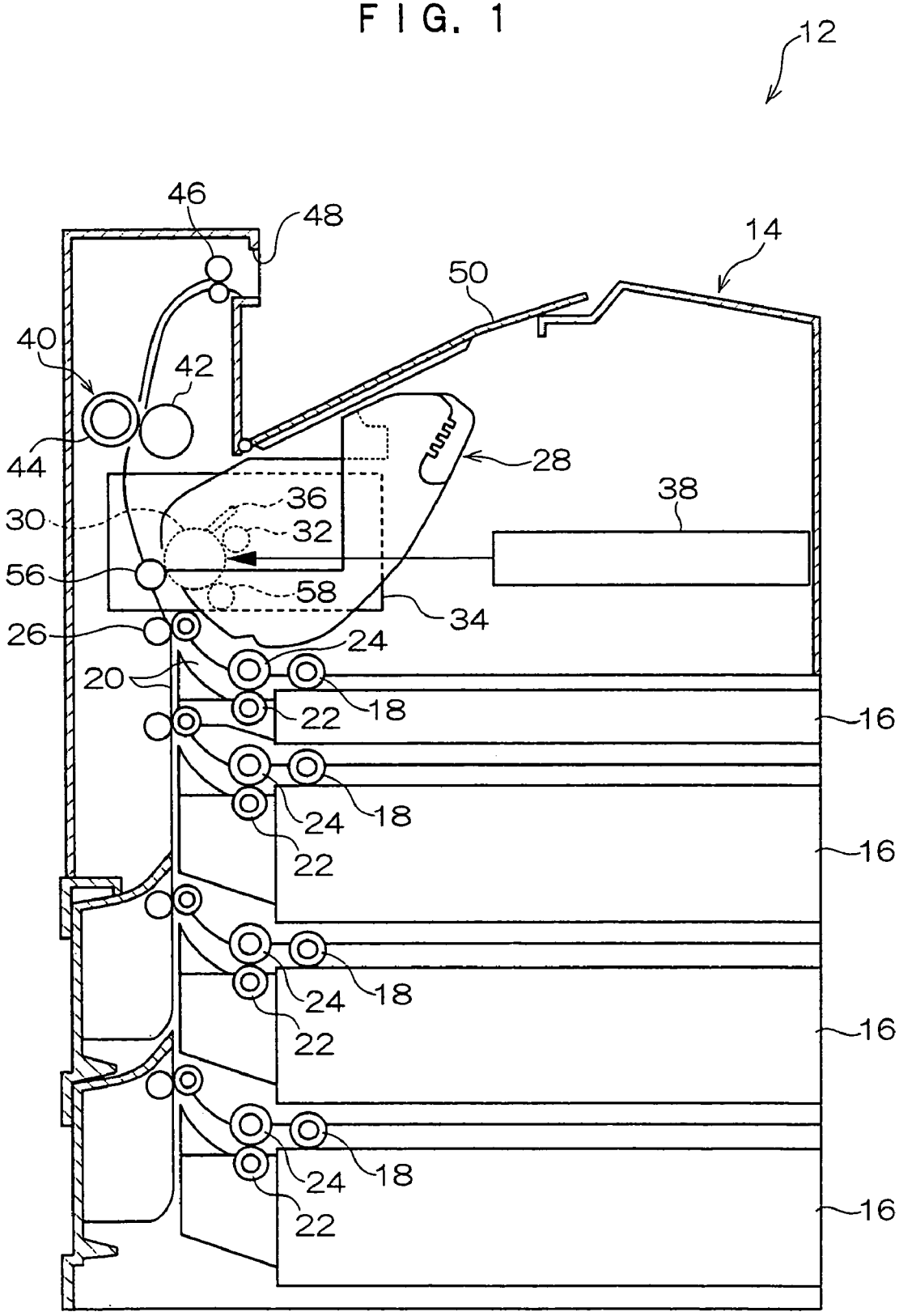
FIG. 1 is a sectional view showing a schematic configuration of an image forming apparatus according to a first embodiment of the invention.

FIG. 1 shows an image forming apparatus 12 of a first embodiment of the present invention. The image forming apparatus 12 of the embodiment forms a toner image on a sheet (recording medium) to obtain a desired image by using the so-called electrostatic recording method, and a monochrome image forming apparatus can be cited as an example in this case.

A main body 14 of the image forming apparatus 12 has one or a plurality of paper feed cassettes 16 (four paper feed cassettes in FIG. 1). The sheets of paper stored in each of the paper feed cassettes 16 are drawn out one by one by a roller 18 and conveyed into a paper feed path 20. A retarder roller 22 and a feed roller 24 are provided in this order in the paper feed path 20 and the paper is conveyed by these rollers.

A registration roller 26 is provided on the downstream side of the retarder roller 22 and the feed roller 24. The paper is stopped once by the registration roller 26 to correct timing of the paper feed, a position, and the like.

A process cartridge 28 is disposed in the image forming apparatus main body 14. A photosensitive drum 30, a charging device 32, a development device 34, and a cleaning device 36 are stored and integrated in the process cartridge 28. The charging device 32 charges the photosensitive drum 30 in an axial direction at a predetermined charging area f. In the charged state, a latent image is formed on the surface of the photosensitive drum 30 with a light beam from a light-beam scanning device 38. The development device 34 causes the toner to adhere to the latent image to form a toner image.

The photosensitive drum 30 and a transfer roller 56 are disposed on the downstream side of the registration roller 26. The toner image on the photosensitive drum 30 is transferred to the paper by conveying the paper with the photosensitive drum 30 and the transfer roller 56 while the photosensitive drum 30 and the transfer roller 56 sandwich the paper.

A fixing device 40 is disposed on the downstream side of the photosensitive drum 30 and the transfer roller 56. For example the fixing device 40 includes a heating roller 42 and a pressurizing roller 44. The toner image on the paper is fixed by conveying the paper with these rollers while heated and pressurized.

The paper on which the toner image is fixed is sandwiched and conveyed with the discharge rollers 46, and the paper is discharged from an outlet 48 to a discharge tray 50.

Figure 2B:
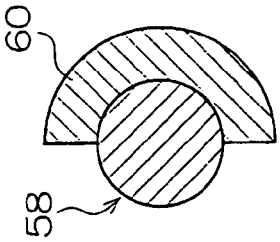
FIG. 2B is a sectional view taken on line B—B of FIG. 2A.
Figure 2A:
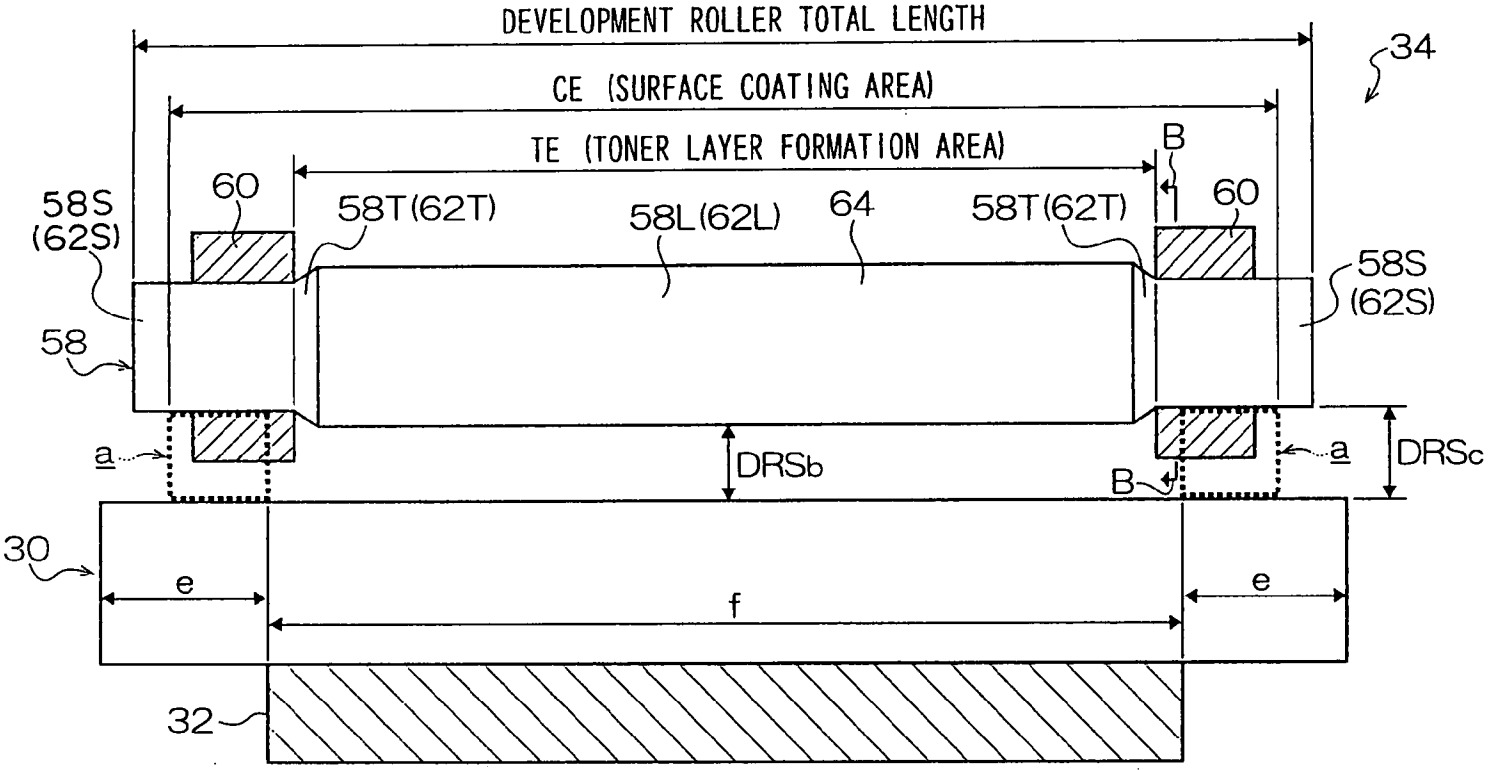
FIG. 2A is a front view showing a development roller and a photosensitive drum of the first embodiment of the invention.

As shown in FIG. 2, the development device 34 has a development roller 58. The gap (DRS) between the development roller 58 and the photosensitive drum 30 is formed by cap type DRS defining members (not shown) fitted to both end portions of the development roller 58. Each DRS defining member includes a thin cylinder portion and a thick abutting portion. The thin cylinder portion forms a portion fitted to the end portion of the development roller 58. The thick abutting portion is formed in a periphery on opening side of the thin cylinder portion and abuts on the photosensitive drum 30. Each DRS defining member is rotatably supported. In order to prevent the toner from scattering out of the development roller 58 to the surroundings, a substantially semi-ring-shaped seal member 60 made of Teflon (trade mark) felt is provided in the proximity of the end portion in the axial direction of the development roller 58 while being in contact with the development roller 58.

The development roller 58 includes a substantially cylindrical development roller base 62 made of aluminum and a coating layer 64 applied to an outer peripheral surface of the development roller base 62. In the embodiment, although the coating layer is made of resin in which conductive fine particles are dispersed, the material of the coating layer is not limited to the resin. It is also possible to provide another coating layer such as an anodic oxide coating layer, a Ni plating layer, and a molybdic acid treatment layer. The development roller base 62 includes a base large diameter portion 62L located in the center in the axial direction, a base tapered portion 62T whose diameter is continuously decreased from the base large diameter portion 62L, and a base small diameter portion 62S which is continuous from the base tapered portion 62T and has the diameter smaller than that of the base large diameter portion 62L. In accordance with the development roller base 62, the development roller 58 includes a large diameter portion 58L, a tapered portion 58T, and a small diameter portion 58S. $DRS_c$ between the small diameter portion 58S and the photosensitive drum 30 is wider than $DRS_b$ between the large diameter portion 58L and the photosensitive drum 30.

In the surface of the development roller base 62, it is assumed that a surface coating area CE is all the base large diameter portion 62L and at least a part of the base tapered portion 62T. (on the side continuous to the base large diameter portion 62L). The surface coating area CE is covered with the coating layer 64. In the example shown in FIG. 2, a part of the base small diameter portion 62S is also covered with the coating layer 64 so that only both end portions of the development roller base 62 in the axial direction are not covered with the coating layer 64.

In the coating layer 64, it is assumed that a toner layer formation area TE is all the base large diameter portions 62L and at least a part corresponding to the base tapered portion 62T. The toner layer is formed on the development roller 58.

Addition of the axial length of the base large diameter portion 62L and the axial length of the base tapered portion 62T (substantially corresponds to the length of the toner layer formation area TE) is shorter than the axial length of a charged area f charged by the charging device 32, and the base small diameter portion 62S further extends toward the center in the axial direction from a boundary between the charged area f and an uncharged area e which is not charged on the photosensitive drum 30.

Figure 3:
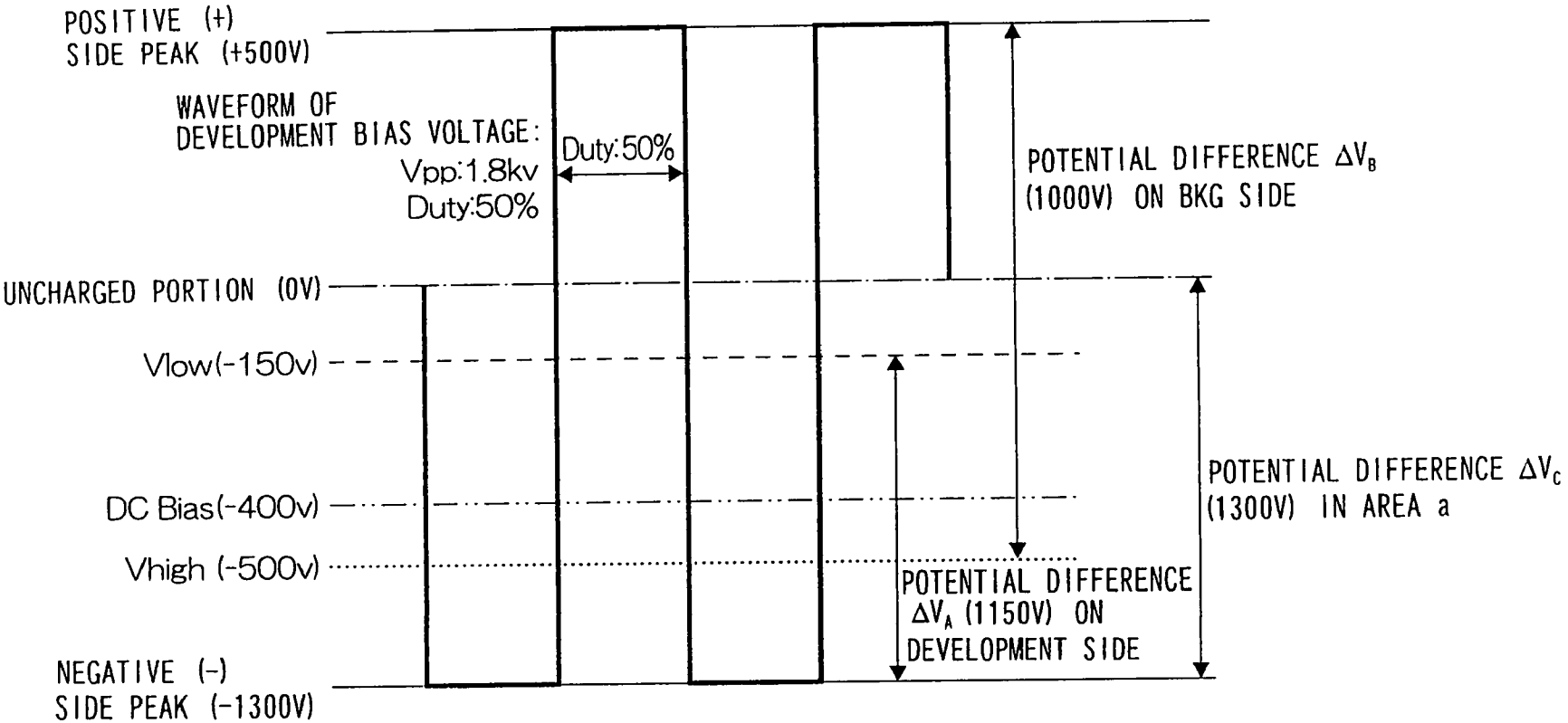
FIG. 3 is a graph showing a voltage waveform applied to a development device of the image forming apparatus of the invention.

FIG. 3 shows an example of voltage (component in which AC and DC are superposed) applied to the photosensitive drum 30 and the development roller 58 (development roller base 62). In the photosensitive drum 30, an electric potential is set to Vlow (−150V) at a position where an image is formed (hereinafter simply referred to as "development side") and the electric potential is set to Vhigh (−500V) at the position where the image is not formed (hereinafter simply referred to as "BKG side"). On the other hand, the voltage in which DC bias of −400V is superposed onto rectangular-wave AC bias having peak-to peak voltage is 1800V in terms of a duty ratio of 50% is applied to the development roller 58 for a development voltage. Therefore, maximum potential difference (potential difference on the development side) $\Delta V_A$ becomes 1150V when the development is performed by transferring the toner from the development roller 58 to the photosensitive drum 30. A maximum potential difference (potential difference on the BKG side) $\Delta V_B$ becomes 1000V when the development is not performed by not transferring the toner from the development roller 58 to the photosensitive drum 30. On the other hand, the uncharged area e of the photosensitive drum 30 becomes 0V because there is no charged member therein, and sometimes the uncharged area is charged to the slightly positive side by frictional electrification with a cleaning blade of the photosensitive drum 30, the seal member and the like, so that a maximum potential difference $\Delta V_C$ between the development roller 58 and the uncharged area e becomes at least 1300V or more.

At this point, considering that the bias leakage occurs when the development bias voltage is applied between the development roller 58 and the photosensitive drum 30, since the toner layer acts as an insulating layer in the toner layer formation area TE, the bias leakage is difficult to occur. On the other hand, the toner layer is not formed on the development roller 58 corresponding to an area "a" shown by a chain double-dashed line in FIG. 2 and the maximum potential difference between the photosensitive drum 30 and the development roller 58 is largest at the area "a", so that the bias leakage easily occurs. Particularly the bias leakage occurs more easily on the condition that the atmospheric pressure is low as in high altitude areas, and even if the bias leakage in the area "a" is prevented by some means, sometimes bias leakage occurs at an area between one area "a" and the other area "a" (hereinafter referred to as area "b") as a starting point of bias leakage. In the example of the voltage waveform shown in FIG. 3, the maximum potential difference $\Delta V_C$ of the area "a" is largest and the bias leak easily occurs in the area "a". However, in the case where the duty ratio of the development bias voltage is set to another value (the peak voltage value becomes larger on the positive side), in the case where a charge voltage value of the photosensitive body is increased, or in the case where the DC bias of the development bias voltage is decreased, sometimes the maximum potential difference $\Delta V_B$ in the area b becomes larger than the maximum potential difference $\Delta V_C$ in the area a and the bias leakage easily occurs in the area b when compared with the area a. In order to prevent the bias leakage in the area b, for example, it is conceivable that DRS between the development roller 58 and the photosensitive drum 30 is increased.

Figure 4B:
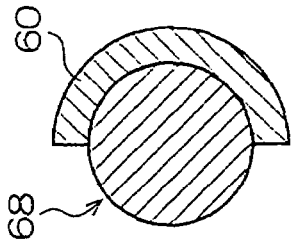
FIG. 4B is a sectional view taken on line B—B of FIG. 4A.
Figure 4A:
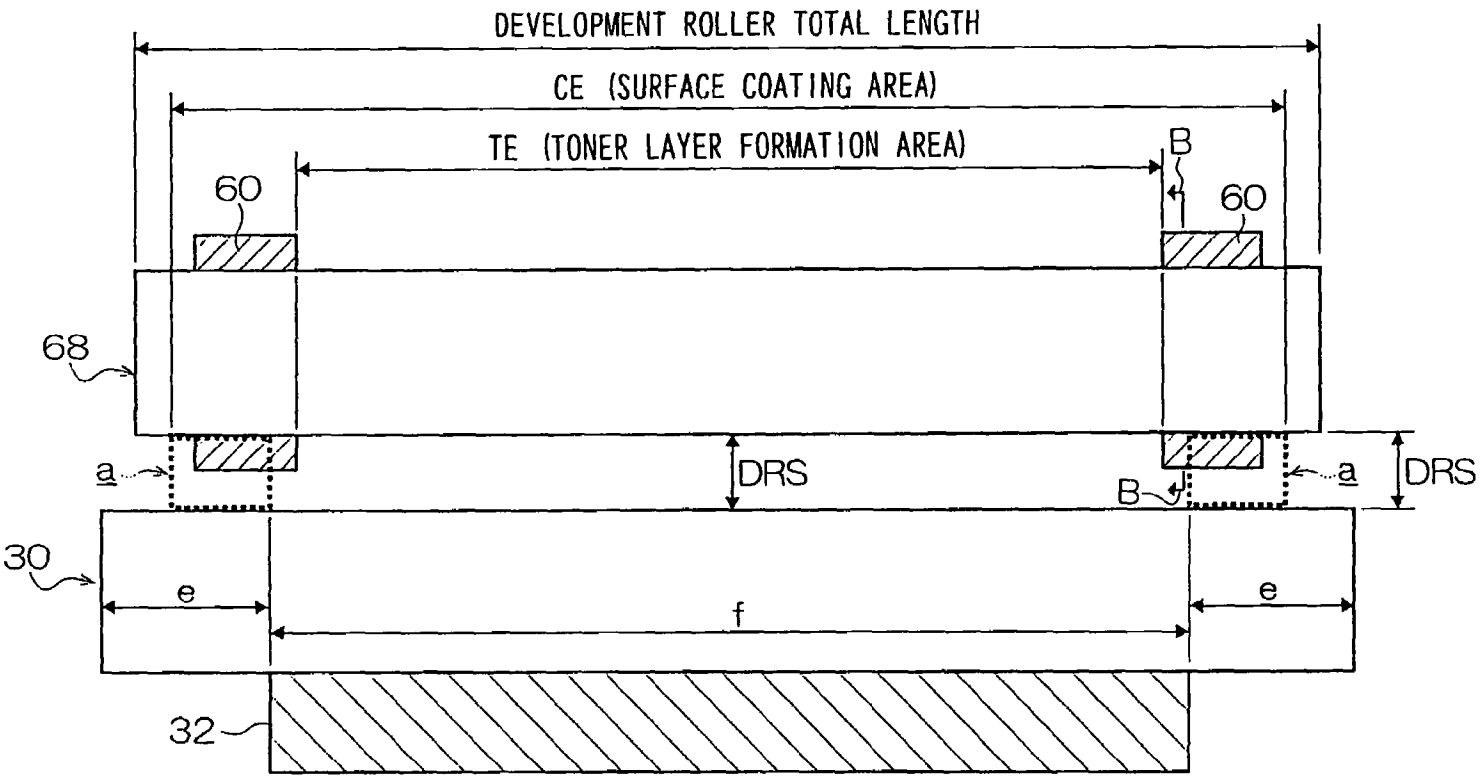
FIG. 4A is a front view showing the development roller and the photosensitive drum of a comparative example.

For the purpose of comparison, a development roller 68 having the configuration shown in FIG. 4 is considered. The development roller 68 is an example of a development roller which does not correspond to the present embodiment. The development roller 68 differs from the development roller 58 of the present embodiment in that the development roller 68 has a constant diameter along the axial direction.

By using the development roller 68, when $DRS_c$ in the area a (the gap between the photosensitive body and the development roller) is increased in order to prevent the bias leakage, $DRS_b$ also increases in the portion outside the area a, i.e., in the position corresponding to the toner layer area TE. Therefore, decrease in image quality may arise such that the development efficiency is reduced to decrease fine-line reproducibility and to decrease solid image density.

It is also conceivable that the bias leakage is prevented without increasing the DRS by simply decreasing the peak-to-peak voltage (difference between the upper peak and the lower peak in the voltage waveform) of the development bias voltage. However, also in this case, decrease in image quality may arise such that the development efficiency is reduced to decrease fine-line reproducibility.

On the other hand, in the present embodiment, the small diameter portion 58S is formed at the development roller 58 corresponding to the area a, and $DRS_b$ corresponding to the large diameter portion 58L is maintained to have a small value while $DRS_c$ has a large value corresponding to the area a. Therefore, the bias leakage is effectively prevented and high development efficiency is maintained, so that the image quality such as the fine-line reproducibility and the solid image density can be maintained at a high level.

Figure 5A:
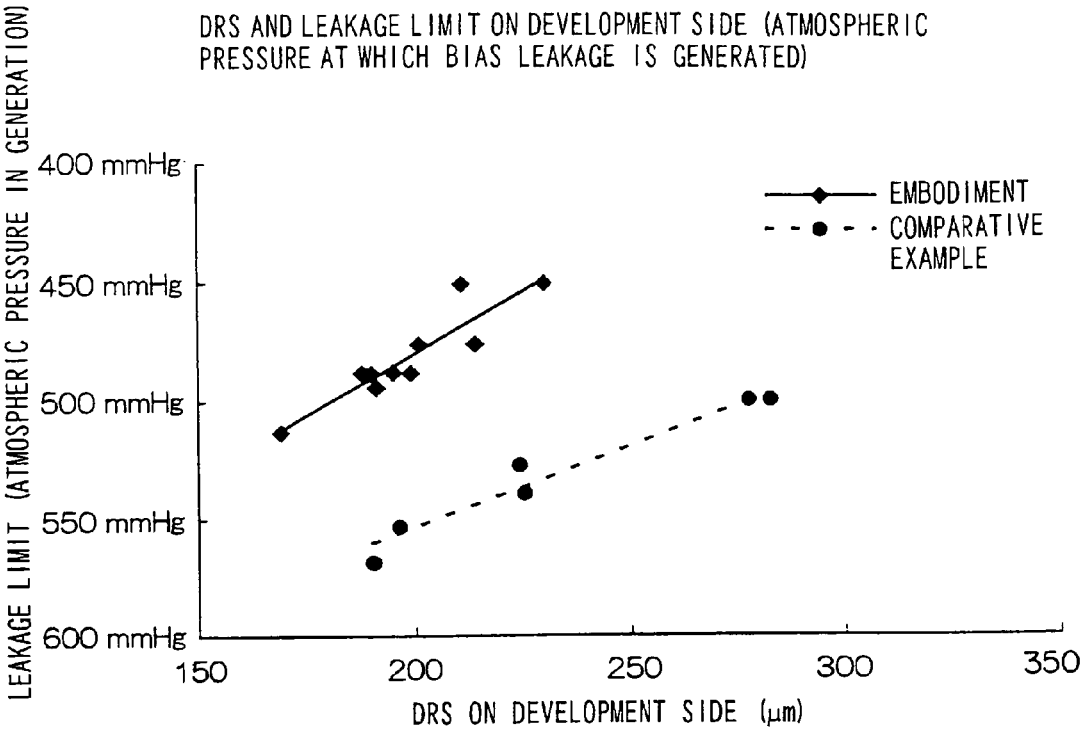
FIG. 5A is a graph showing a relationship between DRS and a leakage limit on a development side.
Figure 5B:
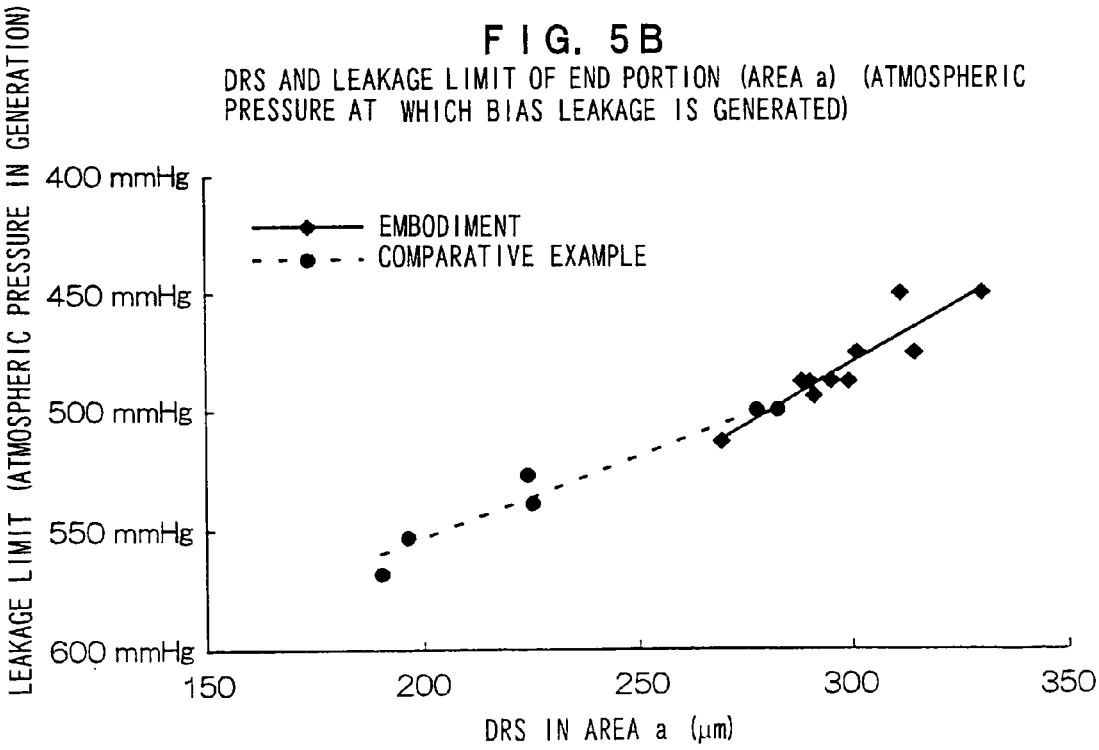

FIGS. 5A and 5B show an example of a relationship between DRS and a leakage limit, i.e., the atmospheric pressure during the generation of the bias leakage in the case where the development roller 58 of the embodiment shown in FIG. 2 is used and the case where the development roller 68 of the comparative example shown in FIG. 4 is used. FIG. 5A shows the relationship between DRS and the leakage limit on the development side, and FIG. 5B shows the relationship between DRS and the leakage limit in the area a.

As can be seen from FIG. 5A, in the toner layer formation area TE, even if $DRS_b$ of the embodiment is narrower than that of the comparative example, the atmospheric pressure of the leakage limit of the embodiment becomes lower than that of the comparative example. As can be seen from FIG. 5B, $DRS_c$ of the area a in the present embodiment has a larger value than that in the comparative example, and the atmospheric pressure of the leakage limit of the embodiment becomes lower than that of the comparative example. Therefore, it is clear that the bias leakage is difficult to occur in the embodiment when the embodiment is compared with the comparative example.

Table 1 shows the relationship among the electric field strength between the development roller 58 or 68 and the photosensitive drum 30, the fine-line reproducibility, and the bias leakage in the case where the development roller 58 of the embodiment shown in FIG. 2 is used and the case where the development roller 68 of the comparative example shown in FIG. 4 is used.

TABLE 1

| | Electric field strength (V/μm) | | | |
|---|---|---|---|---|
| | Development side | Area a | Fine-line reproducibility | Bias leakage (500 mmHg) |
| Comparative example | 3.33 | 3.75 | ○ | X |
| | 3.08 | 3.46 | ○ | X |
| | 2.86 | 3.21 | ○ | ○ |
| | 2.67 | 3.00 | ○ | ○ |
| | 2.50 | 2.81 | Δ | ○ |
| | 2.35 | 2.65 | X | ○ |
| | 2.22 | 2.50 | X | ○ |
| Embodiment | 3.33 | 2.65 | ○ | ○ |
| | 3.08 | 2.50 | ○ | ○ |
| | 2.86 | 2.37 | ○ | ○ |
| | 2.67 | 2.25 | ○ | ○ |
| | 2.50 | 2.14 | Δ | ○ |
| | 2.35 | 2.05 | X | ○ |
| | 2.22 | 1.96 | X | ○ |

In Table 1, the mark of "o" means that there is no problem or influence, the mark of "Δ" means that the problem or influence can be actually neglected while the problem or influence is slightly generated, and the mark of "x" means that there is the problem or influence which can not be neglected.

Figure 6A:
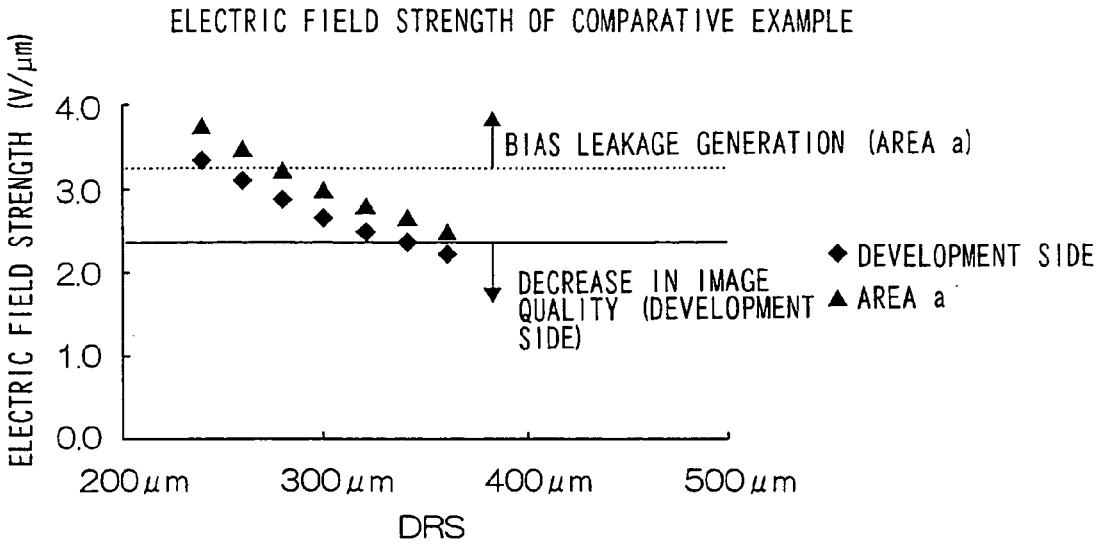
FIG. 6A is a graph of a decrease in image quality and bias leakage generation showing a relationship between DRS and electric field strength of the comparative example.
Figure 6B:
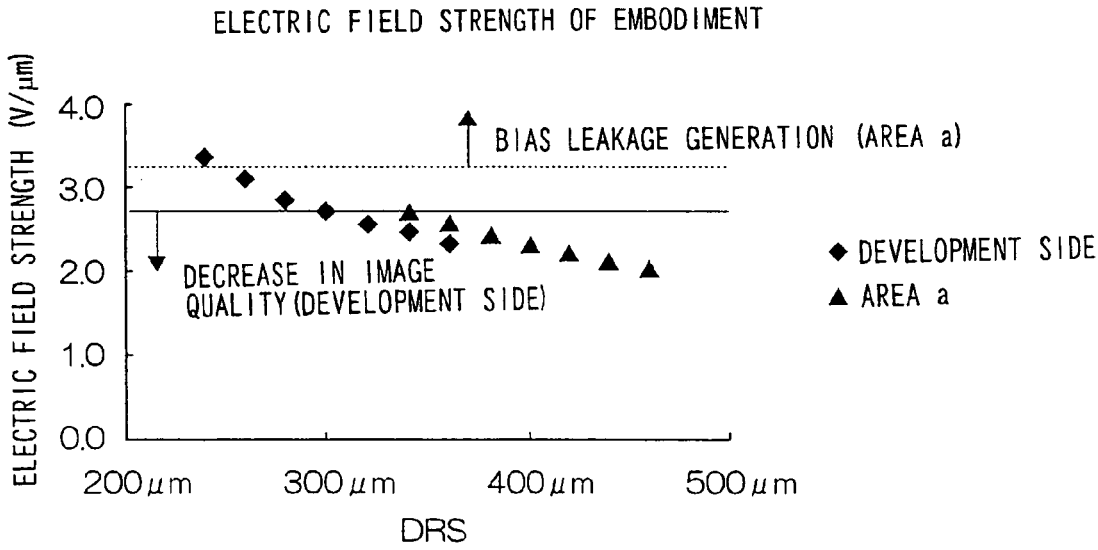
FIG. 6B is a graph of the decrease in image quality and the bias leakage generation showing the relationship between DRS and the electric field strength of the embodiment.

FIGS. 6A and 6B show the relationship between DRS and the electric field strength while a vertical axis is set to the electric field strength and a horizontal axis is set to DRS. The electric field strength can be obtained by dividing the potential difference by DRS. For example, the electric field strength on the development side is obtained by potential difference/DRS on the development side, and the electric field strength on the area a is obtained by potential difference/DRS in the area a. As shown in FIGS. 6A and 6B, each of the electric field strength values in Table 1 is obtained by changing DRS for a specific potential difference between the development roller 58 or 68 and the photosensitive drum 30. $DRS_b$ on the development side is smaller than $DRS_c$ of the area a by 100 μm in the examples shown in Table 1 and the graphs in the embodiment.

As can be seen from Table 1, in the embodiment, since DRS at the toner layer formation area TE differs from DRS at the area a, the electric field strength at the toner layer formation area TE also differs from that at the area a. When the electric field strength is 2.50 V/μm, actually there is no problem with the fine-line reproducibility which largely depends on the electric field strength on the development side, and it is more preferable that the electric field strength is not less than 2.67 V/μm. For the bias leakage which depends on the electric field strength in the area a, it is found that the bias leakage does not occur in any value of the electric field strength shown in Table 1.

In the configuration of the comparative example in which the development roller 68 is used as shown in FIG. 4, the evaluation similar to the embodiment is obtained for the fine-line reproducibility. However, it is found that the bias leakage occurs when the electric field strength is 3.46 V/μm in the area a.

In the configuration shown in FIG. 4, the electric field strength at which the image quality (fine-line reproducibility) is compatible with the prevention of the bias leakage is in a very narrow range from 3.0 to 3.21 V/μm. On the other hand, in the embodiment, since DRS at the area a where generation of the bias leakage may arise can be increased without changing DRS at the toner layer formation area TE, an independent electric field strength is obtained in each of the toner layer formation area TE and the area a, and the generation of the bias leakage can be suppressed while high-quality image is maintained.

The tapered portion 58T formed in the development roller 58 of the embodiment connects the large diameter portion 58L and the small diameter portion 58S without a step to prevent the generation of the bias leakage caused by a corner portion of the step.

Figure 7B:
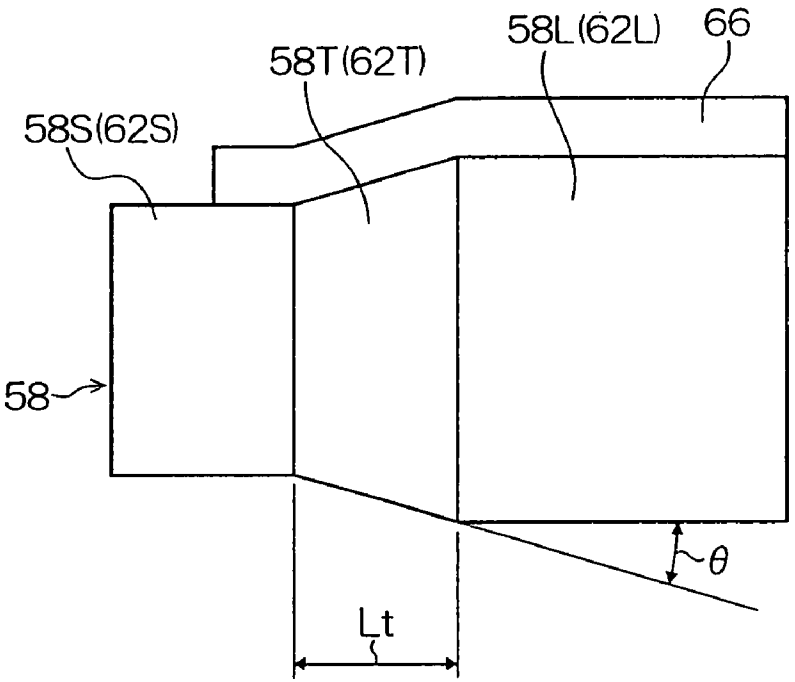
FIG. 7B is an enlarged view showing proximity of an end portion of the development roller according to the invention when a tilt angle of a taper portion is small.
Figure 7A:
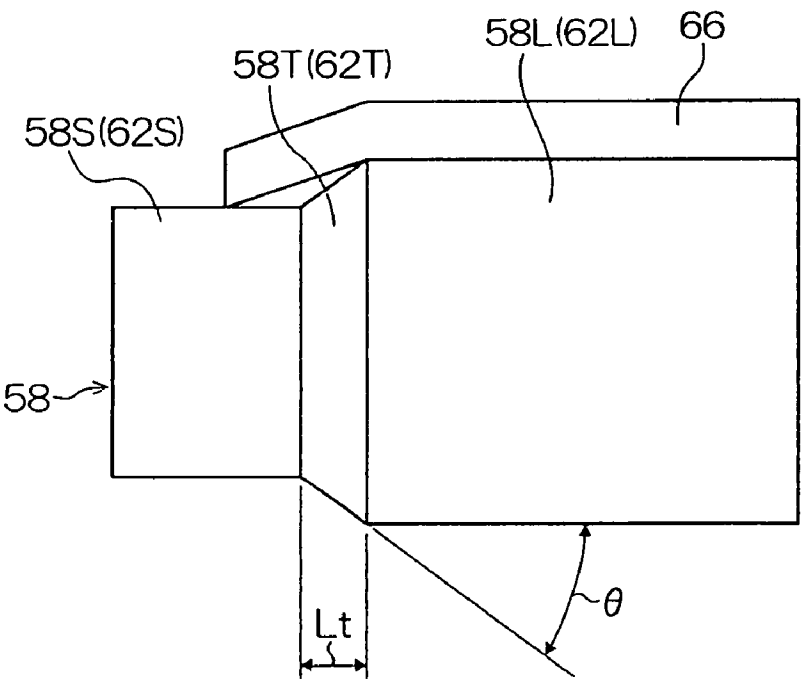
FIG. 7A is an enlarged view showing proximity of an end portion of the development roller according to the invention when a tilt angle of a taper portion is large.

As shown in FIGS. 7A and 7B, a layer formation blade 66 is generally disposed while being in contact with the development roller 58, and a toner layer is formed on the surface of the development roller 58 while the frictional electrification occurs between the layer formation blade 66 and the surface of the development roller 58. Therefore, as can be seen from FIG. 7A, when a tilt angle θ of the tapered portion 58T is too large, the layer formation blade 66 is not in contact with the tapered portion 58T and a gap is generated, which causes a thin film of the stable toner layer not to be formed, and sometimes image quality is deteriorated due to a lack of toner charge.

In order to stably form a toner layer, it is preferable that the tilt angle θ of the tapered portion 58T is decreased. However, when the tilt angle θ is formed very small, since it is necessary to continuously connect the tapered portion 58T to the small diameter portion 58S having the small diameter, an axial-direction length Lt of the tapered portion 58T is increased and the development roller 58 is enlarged.

Table 2 shows the relationship between a combination of the tilt angle θ of the tapered portion 58T and the axial-direction length Lt and the generation of the fault of the layer formation in forming the toner layer.

TABLE 2

| | Lt (mm) | | | | | | |
|---|---|---|---|---|---|---|---|
| θ (degree) | 4.0 | 4.5 | 5.0 | 5.5 | 6.0 | 6.5 | 7.0 |
| 0.50 | Δ | ○ | ○ | ○ | ○ | ○ | ○ |
| 1.00 | Δ | ○ | ○ | ○ | ○ | ○ | ○ |
| 2.00 | Δ | ○ | ○ | ○ | ○ | ○ | ○ |

TABLE 2-continued

| | Lt (mm) | | | | | | |
|---|---|---|---|---|---|---|---|
| θ (degree) | 4.0 | 4.5 | 5.0 | 5.5 | 6.0 | 6.5 | 7.0 |
| 3.00 | Δ | ○ | ○ | ○ | ○ | ○ | ○ |
| 4.00 | Δ | Δ | Δ | Δ | Δ | Δ | Δ |
| 5.00 | X | X | X | X | X | X | X |

In Table 2, the mark of "o" means that the fault of the toner layer formation is not generated and there in no influence on the image quality, the mark of "Δ" means that there is no influence on the image quality while the fault of the toner layer formation is slightly generated, and the mark of "x" means that the fault of the toner layer formation is generated and the influence such as a defect appears in the image quality.

As can be seen from Table 2, in order to prevent the fault of the toner layer formation, it is preferable that the tilt angle θ of the tapered portion 58T is formed not more than 4.00 degrees, and it is more preferable that the tilt angle θ is formed not more than 3.00 degrees. It is preferable that the axial-direction length Lt of the tapered portion 58T is formed not less than 4.0 mm, and it is more preferable that the axial-direction length Lt is formed not less than 4.5 mm.

In order that the small diameter portion 58S is securely formed to have a small diameter and the development roller 58 is prevented from enlarging, it is preferable that the tilt angle θ of the tapered portion 58T is not less than 0.50 degrees and the axial-direction length is not more than 7.0 mm.

It is not always necessary that the tapered portion 58T is all located outside the toner layer formation area TE in the axial direction. It is possible that a part of the tapered portion 58T intrudes into the toner layer formation area TE. Therefore, the length of the development roller 58 can be shortened and miniaturization of the image forming apparatus 12 can be achieved.

In addition to the above, it is conceivable that a slight irregularity (particularly convex portion) generated in the surface of the coating layer 64 causes the bias leakage between the photosensitive drum 30 and the development roller 58. When a convex portion exists in the coating layer 64, bias leakage easily occurs between a tip end of the convex portion and the photosensitive drum 30. Sometimes the convex portion of the coating layer 64 is generated when the coating layer 64 is formed on the development roller base 62 of the development roller 58 by the so-called dipping. The generation of the convex portion will be described below.

Figure 8A:
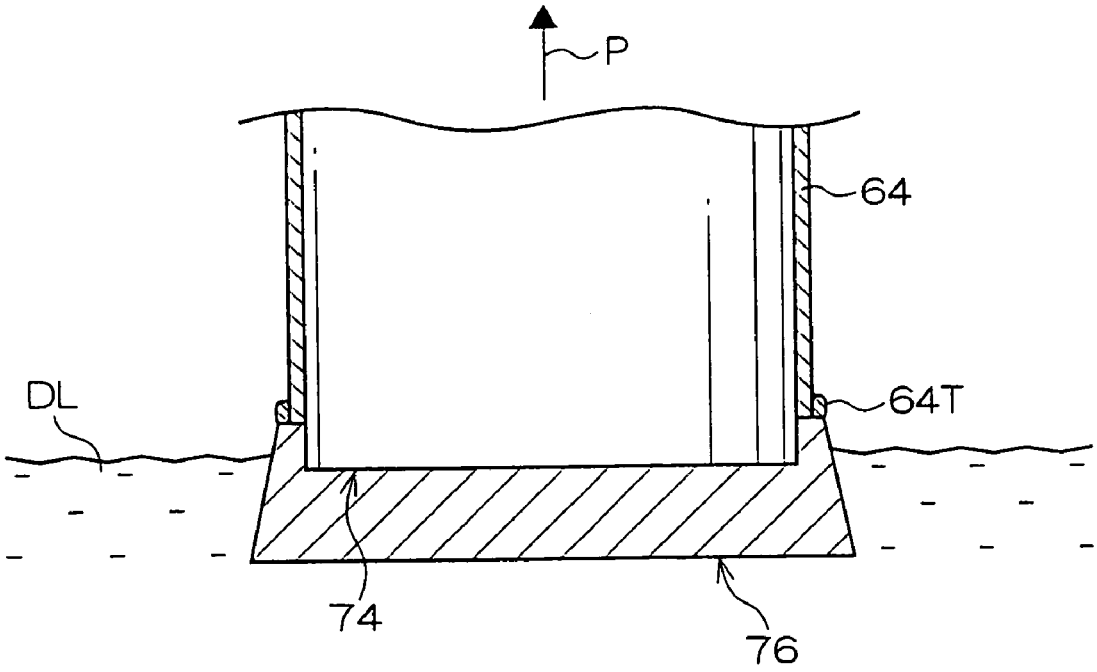
FIG. 8A is a sectional view of the end portion showing a process of manufacturing the development roller of the comparative example.
Figure 8B:
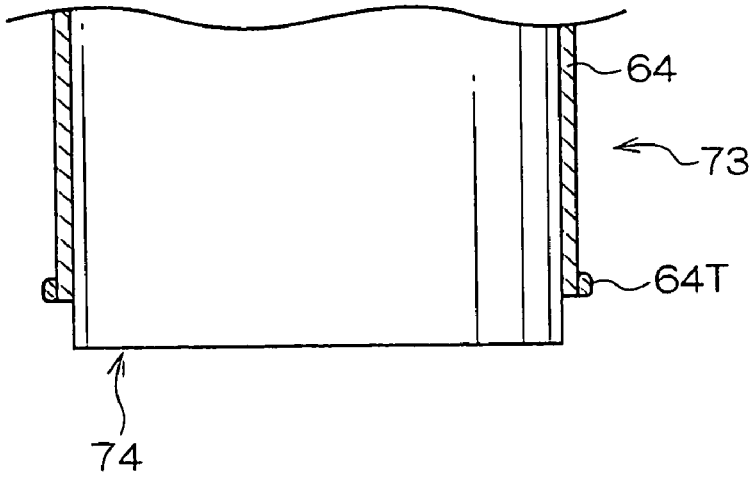
FIG. 8B is a sectional view of the end portion showing the development roller obtained by the manufacturing method of FIG. 8A.
Figure 9A:
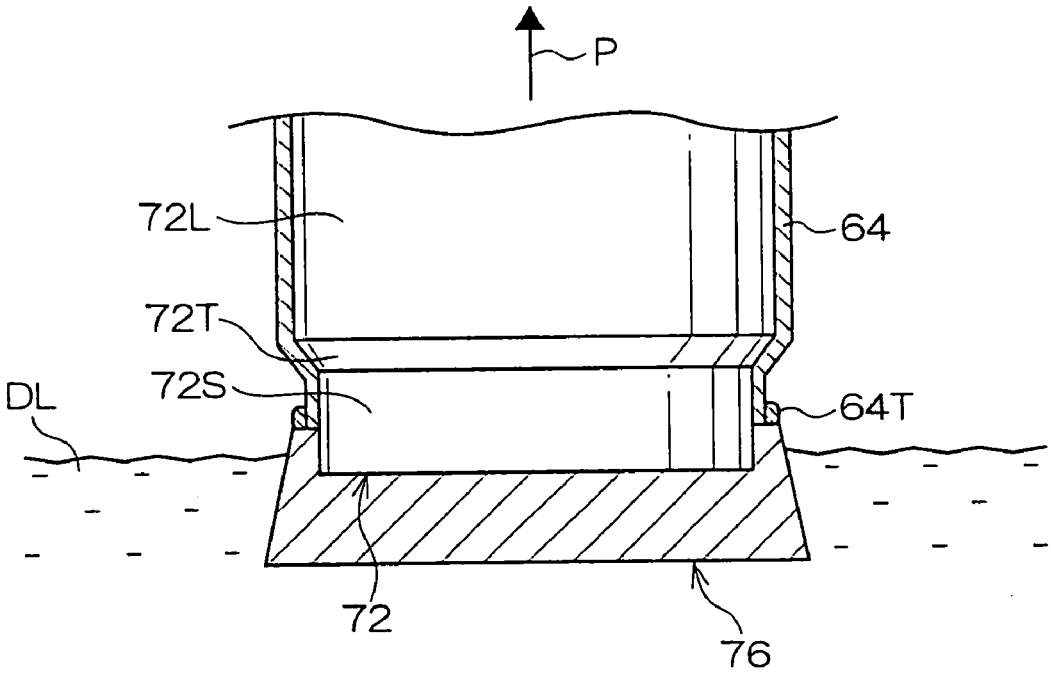
FIG. 9A is a sectional view of the end portion showing a process of manufacturing a development roller according to a second embodiment of the invention.
Figure 9B:
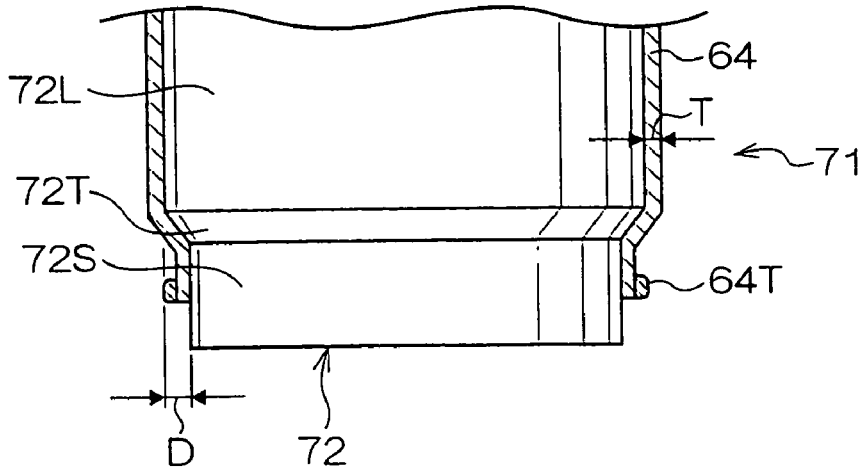
FIG. 9B is a sectional view of the end portion showing the development roller obtained by the manufacturing method of FIG. 9A.

FIG. 8A shows a process of forming the coating layer 64 by dipping a cylindrical development roller base 74 (having a constant outer diameter in the axial direction), to which the invention is not applied, into a coating solution DL, and FIG. 8B shows a development roller 73 obtained by the process of FIG. 8A. FIG. 9A shows a process of forming the coating layer 64 by dipping a development roller base 72 according to a second embodiment of the invention into the coating solution DL, and FIG. 9B shows a development roller 71 obtained by the process of FIG. 9A. Similarly to the development roller base 62 of the first embodiment, in the development roller base 72 of the second embodiment, base small diameter portion 72S (having a difference D from a base large diameter portion 72L) having the diameter smaller than that of the central portion in the axial direction is formed at the both end portions in the axial direction through a base tapered portion 72T. In each of FIG. 8A and FIG. 9A, a masking cap 76 is fitted to the end portion which becomes lower side in the dipping so that the coating solution DL does not intrude into the end portion of the development roller base 72 or 74.

When the development roller base 74 to which the invention is not applied is extracted upward (in the direction of arrow P) from the coating solution DL, the coating solution DL runs down along the periphery of the development roller base 74 and is stemmed by the masking cap 76 to generate a solution built-up (convex portion 64T) projecting toward the outside in a radial direction of the development roller base 74. When the convex portion 64T is generated, since the distance between the development roller 73 and the photosensitive drum 30 is locally decreased at the convex portion 64T, the bias leakage easily occurs.

On the other hand, in the development roller base 72 of the invention, even if the convex portion 64T is generated by the solution built-up in extracting the development roller base 72 from the coating solution DL, the convex portion 64T is generated in a base smaller diameter portion 72S. Therefore, the tip end of the convex portion 64T does not project outward in the radial direction from the base large diameter portion 72L or the projection length of the convex portion 64T becomes shorter, which allows the bias leakage to be prevented between the development roller 71 and the photosensitive drum 30.

Although the difference D between the base large diameter portion 72L and the base small diameter portion 72S is not particularly limited as long as the bias leakage caused by the convex portion 64T can be prevented, it is preferable that the difference D is formed at least two times or more of a film thickness T of the coating layer 64 applied to the base large diameter portion 72L. By way of example, when the film thickness of the coating layer 64 is about 20 μm, the difference D may be set to about 40 μm.

Although the development roller base 72 in which the difference D is formed by the base small diameter portion 72S continuously formed from the base tapered portion 72T is shown in the example in FIG. 9, sometimes the difference in diameters of the base large diameter portion 72L and the base small diameter portion 72S does not meet the condition of the difference D. In this case, a portion having a diameter smaller than that of the base small diameter portion 72S may be further formed on the end portion of the base small diameter portion 72S to obtain the difference D satisfying the condition.

The overall configuration of the image forming apparatus according to the second embodiment of the invention is substantially similar to that according to the first embodiment except that the development roller manufactured by the manufacturing method shown in FIG. 9 is applied. Therefore, the detail description thereof will be omitted.

Figure 10A:
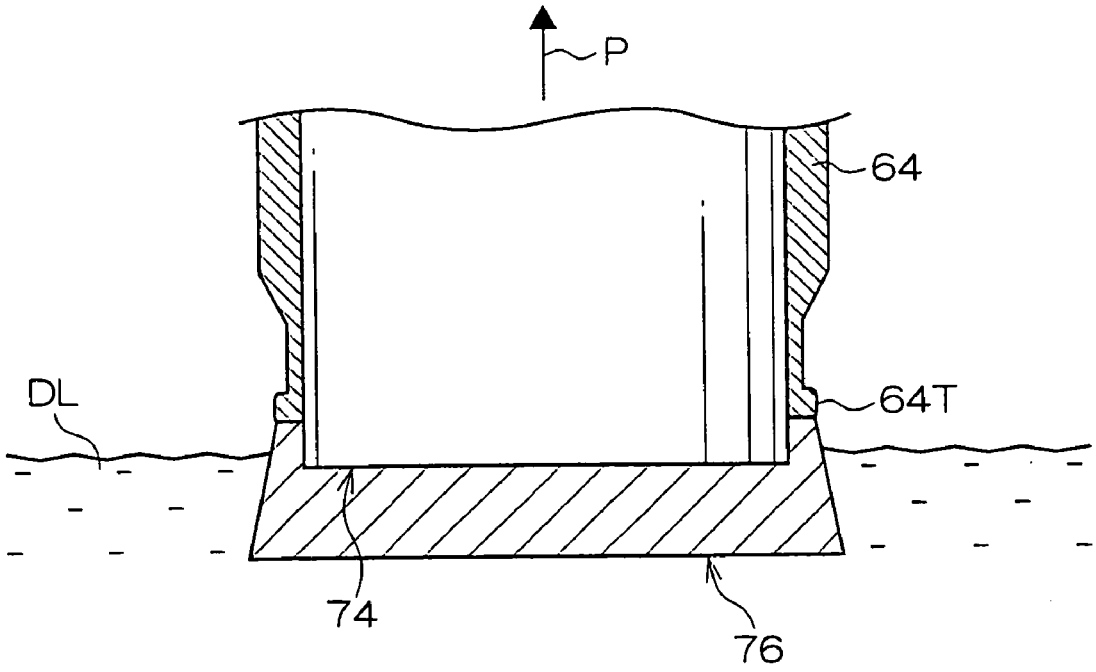
FIG. 10A is a sectional view of the end portion showing a process of manufacturing a development roller according to a modification of the second embodiment of the invention.
Figure 10B:
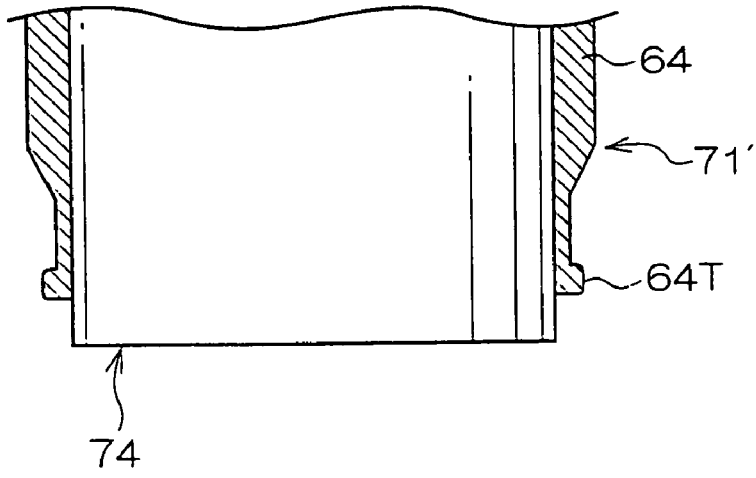
FIG. 10B is a sectional view of the end portion showing the development roller obtained by the manufacturing method of FIG. 10A.

FIG. 10 shows a modification of the second embodiment of the invention. As in the example shown in FIG. 10, it is possible that the projection length of the convex portion 64T caused by the solution built-up is suppressed to be short by thinning the coating film thickness of the end portion on the lower side of a development roller 71'. With reference to the method of thinning the coating film thickness, it is possible that the thin coating film is formed by slowing an extraction rate of the end portion on the lower side in extracting the roller base from the coating solution DL lower than the usual extraction rate. In FIG. 10, although the coating film is formed on the roller base 74 having the constant diameter, it is also possible that the same process is applied to the roller base 72 having the base small diameter portion 72S and the base tapered portion 72T. Accordingly, even if the thickness of the roller base has the limitation, the development roller having a small diameter portion can be easily manufactured.

Figure 11B:
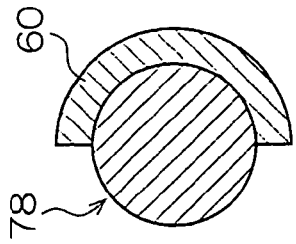
FIG. 11B is a sectional view taken on line B—B of FIG. 11A.
Figure 11A:
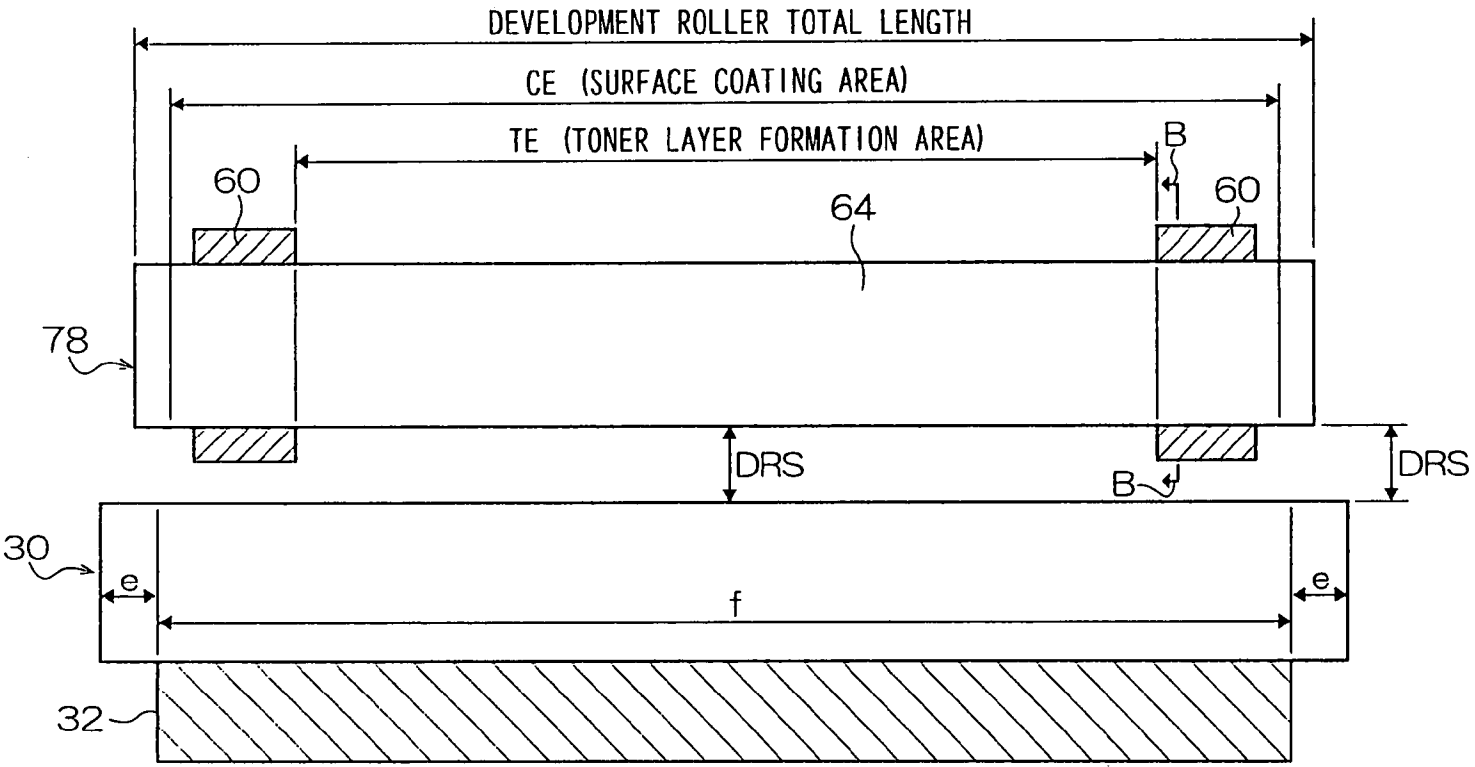
FIG. 11A is a front view showing a development roller and a photosensitive drum of a third embodiment of the invention.

FIG. 11 shows a development roller 78 and the proximity of the development roller 78 of the image forming apparatus according to a third embodiment of the invention. In the third embodiment, the overall configuration of the image forming apparatus is also substantially similar to that according to the first embodiment.

When compared with the first embodiment, the development roller 78 of the third embodiment is adapted to be formed in a cylindrical shape having a constant diameter in the axial direction. The relative position between the charging device 32 and the seal member 60 is determined so that the seal member 60 is located inside the uncharged area e by the charging device 32 in the axial direction of the development roller 78.

In the development roller 78, generally the surface shape is partially changed by the friction with the seal member 60 or the intrusion of the toner during the rotation to generate slight damage. Similarly to the second embodiment, sometimes the slight damage causes the bias leakage.

However, as described above, the abutting position of the seal portion 60 is located inside the uncharged area e by the charging device 32 in the axial direction of the development roller 78. In the development roller 78, because the maximum potential difference is lower in the portion corresponding to the charged area when compared with the uncharged area, the bias leakage is difficult to occur. Even if the surface shape of the development roller 78 is changed at the portion corresponding to the charged area, there is a low possibility that the bias leakage occurs.

Thus, the bias leakage can be also prevented in the third embodiment, and DRS between the development roller 78 and the photosensitive drum 30 can be decreased to maintain high image quality.

Figure 12A:
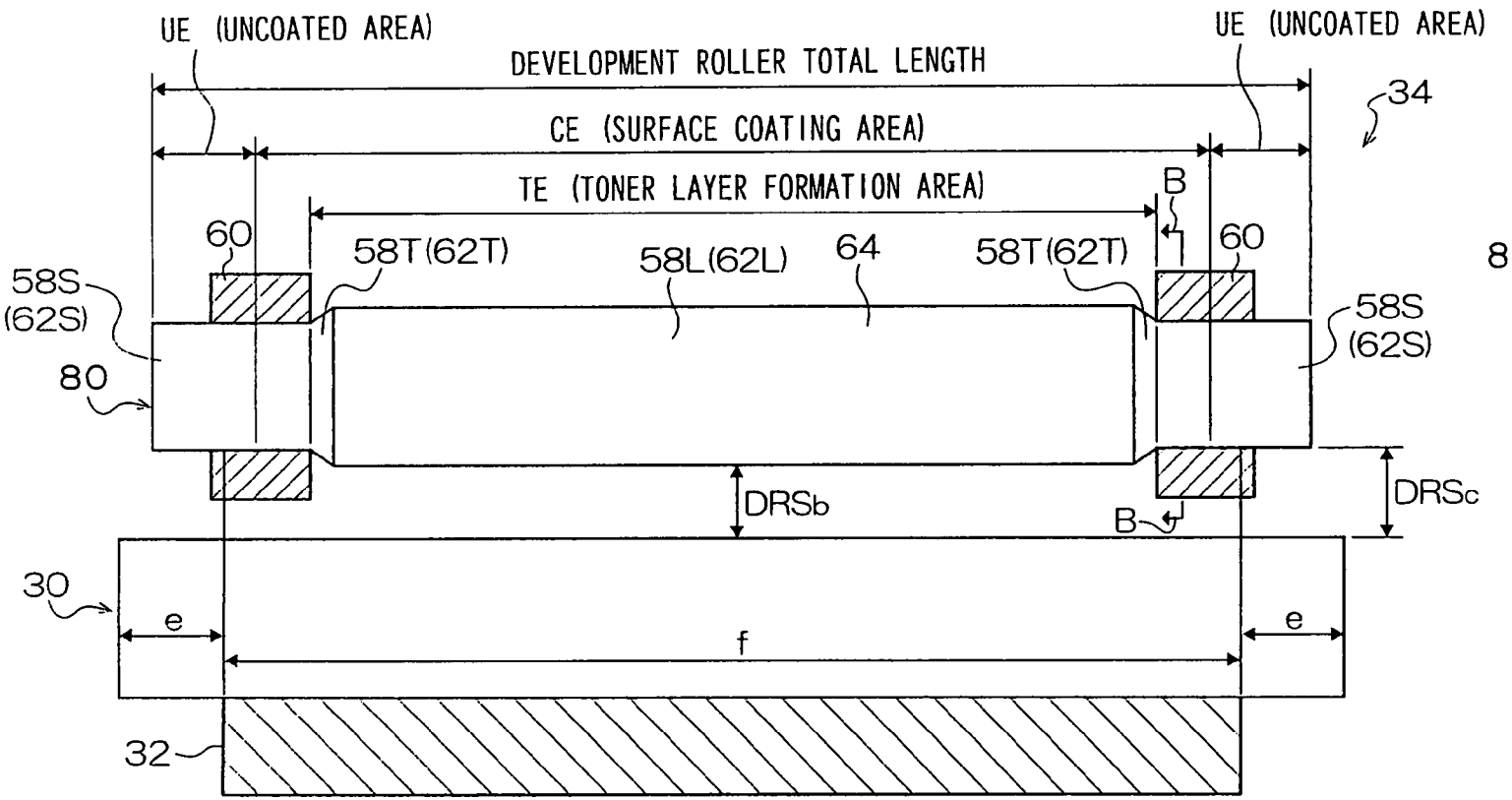
FIG. 12A is a front view showing a development roller and a photosensitive drum of a fourth embodiment of the invention.
Figure 12B:
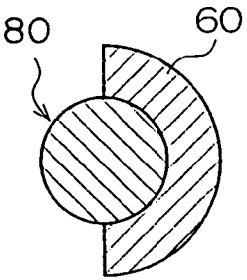
FIG. 12B is a sectional view taken on line B—B of FIG. 12A.

FIG. 12 shows a development roller 80 and the proximity of the development roller 80 of the image forming apparatus according to a fourth embodiment of the invention. In the fourth embodiment, the overall configuration of the image forming apparatus is also substantially similar to that according to the first embodiment.

In the fourth embodiment, when compared with the first embodiment, a structure of the development roller 80 and the relative position between the development roller 80 and the charging device 32 are determined so that an uncoated area UE of the end portion of the development roller 80 (uncoated layer portion where the coating layer 64 is not provided on the surface) is located inside the end portion of the charged area f in the axial direction. The bias leakage can be more surely prevented by locating the uncoated area of the development roller 80 inside the uncharged area in the axial direction. For example, even if the type of the coating layer formed on the surface of the development roller is changed from a viewpoint of improvement of the image quality (for example, the coating layer having the lower resistance is formed), the bias leakage can be more surely prevented in the area a of FIG. 2. Therefore, DRS between the development roller 80 and the photosensitive drum 30 can be decreased to maintain high image quality.

The method of manufacturing the development roller 80 of the fourth embodiment is not particularly limited. For example, when the coating is performed by the dip coating technique in which the coating layer is formed by dipping the development roller base into the coating solution DL as shown in FIG. 9, the development roller base is dipped up to the proximity of the upper end portion during the dipping, which enables the uncoated area to be easily provided. Since the coating layer is not formed in the portion to which the masking cap 76 is attached, the uncoated area can be provided by adjusting the length of the masking cap 76.

Figure 13B:
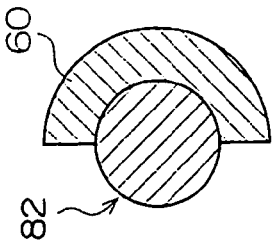
FIG. 13B is a sectional view taken on line B—B of FIG. 13A.
Figure 13A:
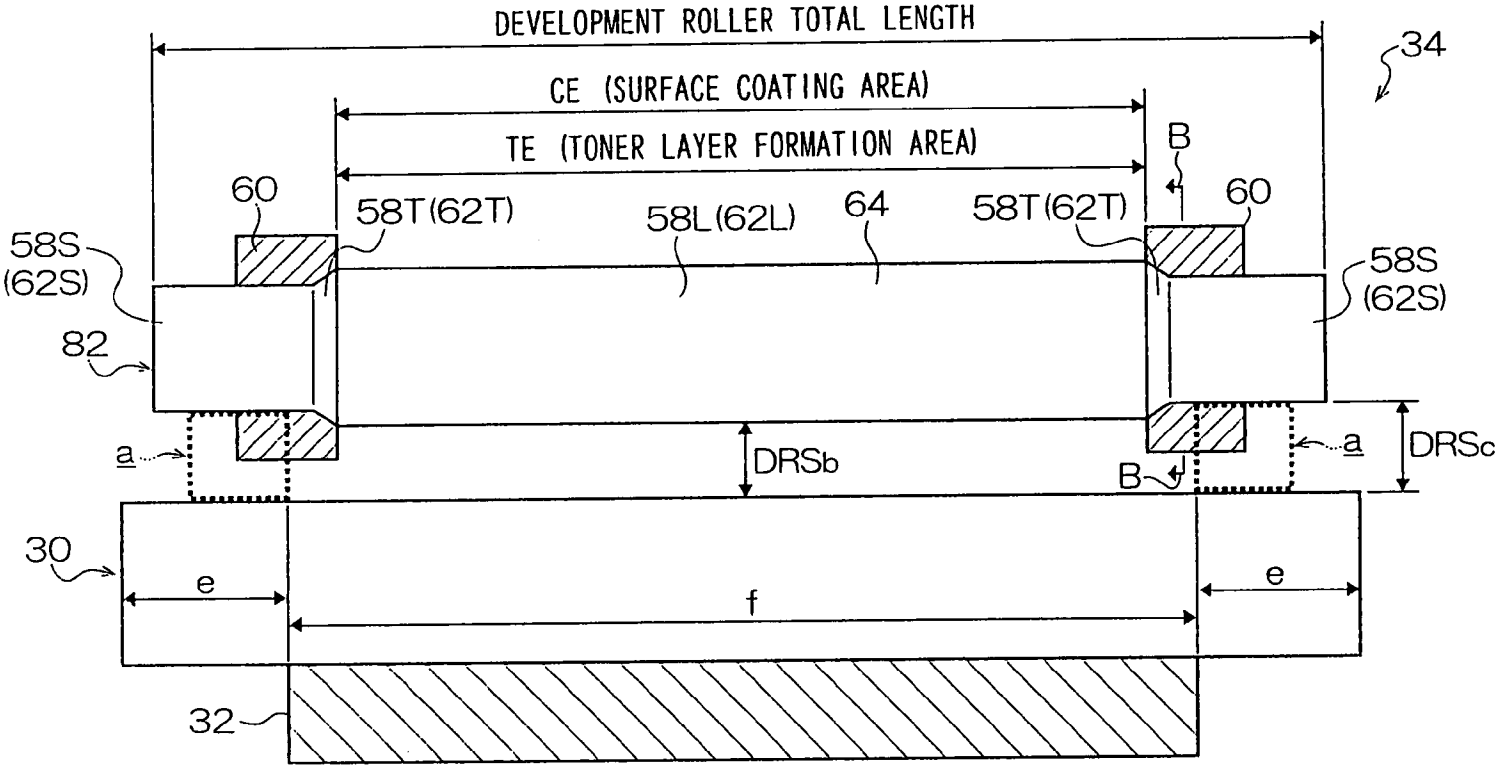
FIG. 13A is a front view showing a development roller and a photosensitive drum of a fifth embodiment of the invention.

FIG. 13 shows a development roller 82 and the proximity of the development roller 82 of the image forming apparatus according to a fifth embodiment of the invention. In the fifth embodiment, the overall configuration of the image forming apparatus is also substantially similar to that according to the first embodiment.

In the fifth embodiment, while the development roller 82 has the large diameter portion 58L, the tapered portion 58T, the small diameter portion 58S similarly to the first embodiment, the surface coating area CE is equal to the toner layer formation area TE, and the tapered portion 58T and the small diameter portion 58S are formed outside the surface coating area CE in the axial direction. Namely, the area except for the surface coating area CE is formed in the small diameter compared to the large diameter portion 58L.

Even if the fifth embodiment has the above-described configuration, because the area a where the bias leakage easily occurs becomes the uncoated area having a small diameter, the bias leakage can be prevented from generating.

Although the development roller 78 having a constant diameter in the axial direction is used in the third embodiment, similarly to the first embodiment, it is also possible to use the development roller 58 having the tapered portion 58T and the small diameter portion 58S. Although the development roller 80 having the tapered portion 58T and the small diameter portion 58S is used in the fourth embodiment, similarly to the third embodiment, it is also possible to use the development roller having a constant diameter in the axial direction, or it is also possible to use the development roller 71 of the second embodiment.

In the above descriptions, although the monochrome image forming apparatus is cited as an example of the image forming apparatus of the invention, it is also possible that the image forming apparatus of the invention is one in which an image is formed by using multiple colors of the toner (for example, full color).

In the invention, it is preferable that the small diameter portion is disposed to be opposite to an area of the photosensitive body, which area is not charged by the charging member.

Since the bias leakage is particularly easy to occur in the portion corresponding to the area of the photosensitive body in which the charging is not performed by the charging member, at least a part of the portion is formed in the small diameter portion having a diameter smaller than that of the toner layer formation area where the toner layer is formed, and DRS between the photosensitive body and the development roller is increased. Therefore, the bias leakage can be securely prevented in the portion. Further, since at least a part of the toner layer formation area is not formed in the small diameter, DRS can be decreased at the portion and the development efficiency can be increased to obtain a high-quality image.

In the invention, it is preferable to have the seal member which is disposed near the end portion in the axial direction of the development roller while being in contact with the development roller and which prevents the toner from moving toward the outside in the axial direction. It is also preferable that at least a part of the area which is in contact with the seal member is formed in the small diameter portion having a diameter smaller than that of the toner layer formation area where the toner layer is formed.

In the development roller, the surface shape is partially changed by the friction with the seal member or the intrusion of the toner during the rotation to generate slight damage. Sometimes the slight damage causes the bias leakage.

In the invention, at least a part of the portion which is in contact with the seal member is formed in the small diameter portion having the diameter smaller than that of the toner layer formation area where the toner layer is formed, and DRS between the photosensitive body and the development roller is increased. Therefore, the bias leakage can be securely prevented in the portion. Further, since the toner layer formation area is not formed in the small diameter, DRS can be narrowed in the portion corresponding to the toner layer formation area and the development efficiency can be increased to obtain a high-quality image.

In the invention, it is preferable that the tapered portion whose diameter is continuously decreased toward the end portion in the axial direction is formed near a boundary of the toner layer formation area around the small diameter portion.

When the tapered portion is formed in the above-described manner, the toner layer can be uniformly formed on the development roller when compared with the configuration having a step between the toner layer formation area and the small diameter portion.

It is also possible that a part of the tapered portion intrudes into the toner layer formation area, which allows the length of the development roller to be shortened.

In the invention, it is preferable that the tilt angle of the tapered portion ranges from 0.5 to 4.00 degrees with respect to the toner layer formation area.

When the tilt angle of the tapered portion is formed not more than 4.00 degrees, the toner layer can be more uniformly formed on the development roller. From a viewpoint of the formation of the uniform toner layer, there is no lower limit of the tilt angle. However, the length in the axial direction of the tapered portion is increased when the tilt angle is extremely decreased. Therefore, the length of the tapered portion can be prevented from excessively increasing by setting the tilt angle not less than 0.5 degree. It is also possible that the toner layer is uniformly formed on the development roller by setting the length of the tapered portion in the axial direction of the development roller to the value not less than 4.5 mm. In this case, from a viewpoint of the formation of the uniform toner layer, there is no upper limit of the length of the tapered portion. However, the length of the tapered portion can be prevented from excessively increasing by setting the length not more than 7.0 mm.

What is claimed is:

1. A development roller disposed in proximity of a photosensitive body which is charged by a charging member and on which an electrostatic latent image is formed, the development roller performing development by transferring toner to the photosensitive body, the development roller comprising:

a toner layer formation area where a toner layer is formed on a surface of a development roller main body portion; and a small diameter portion which has a diameter smaller than that of the toner layer formation area and which is located in at least a part of an area where the toner layer is not formed on the surface of the development roller main body portion, wherein an axial length of the toner layer formation area is less than an axial length of a charged area that includes said toner layer formation area and at least a portion of said small diameter portion.

2. A development roller according to claim 1, wherein the small diameter portion is disposed to be opposite to an area of the photosensitive body, wherein at least a portion of the area of the photosensitive body is not charged by the charging member.

3. A development roller according to claim 1, further comprising:

a seal member which is disposed to be in contact with the development roller main body portion in the proximity of an end portion in the axial direction of the development roller main body portion and which prevents the toner from moving toward an outside in an axial direction, wherein the seal member is in contact with at least a part of the small diameter portion.

4. A development roller according to claim 1, wherein the toner layer formation area includes a large diameter portion having a certain diameter, and a tapered portion whose diameter continuously decreases from the large diameter portion toward the end portion in the axial direction is formed between the large diameter portion and the small diameter portion.

5. A development roller according to claim 4, wherein a tilt angle ranges from 0.50 to 4.00 degrees with respect to the large diameter portion of the tapered portion.

6. A development roller according to claim 4, wherein a length of the tapered portion measured in the axial direction of the development roller main body portion ranges from 4.5 to 7.0 mm.

7. A development roller disposed in proximity of a photosensitive body which is charged by a charging member and on which an electrostatic latent image is formed, the development roller performing development by transferring toner to the photosensitive body, the development roller comprising:

a development roller base; and a coating layer which is formed on a surface of the development roller base, wherein a toner layer is formed on the coating layer, and a portion of the development roller base corresponding to an area where the coating layer is not formed is included in a small diameter portion whose diameter is smaller than that of an approximately central portion of the development roller base in the axial direction corresponding to an area where the coating layer is formed, and an end of the approximately central portion includes a tapered region which is adjacent to the small diameter portion.

8. The development roller of claim 7, said coating layer further comprising a built-up portion at axial ends of said coating layer on the development roller base.

9. The development roller of claim 7, wherein said tapered portion and said small diameter portion comprise regions of said coating layer having respective tapered portions and small diameter portions, and said development roller base has a substantially constant diameter.

10. A development roller base that is used for a development roller disposed in proximity of a photosensitive body which is charged by a charging member and on which an electrostatic latent image is formed, the development roller performing development by transferring toner to the photosensitive body, the development roller base comprising a base small diameter portion which has a diameter smaller than that of other portions of the development roller base and which is located in at least one end portion in an axial direction of the development roller base, and an end of the approximately central portion includes a tapered region which is adjacent to the small diameter portion.

11. An image forming apparatus comprising:

a photosensitive body on which an electrostatic latent image is formed;

a charging member which charges the photosensitive body; and a development roller which performs development by transferring toner to the photosensitive body charged by the charging member, the development roller being disposed near the photosensitive body, the development roller including a toner layer formation area where a toner layer is formed on a surface of a development roller main body portion, and a small diameter portion having a diameter smaller than that of the toneX layer formation area in at least a part of an area where the toner layer is not formed on the surface of the development roller main body portion, and an end of the approximately central portion includes a tapered region which is adjacent to the small diameter portion.

12. An image forming apparatus comprising:

a photosensitive body on which an electrostatic latent image is formed;

a charging member which charges the photosensitive body; and a development roller which performs development by transferring toner to the photosensitive body charged by the charging member, the development roller being disposed near the photosensitive body, the development roller including a development roller base and a coating layer formed on a surface of the development roller base, wherein a toner layer is formed on the coating layer, and a portion of the development roller base corresponding to an area where the coating layer is not formed is included in a small diameter portion having a diameter smaller than that of an approximately central portion of the development roller base in the axial direction corresponding to an area where the coating layer is formed, and an end of the approximately central portion includes a tapered region which is adjacent to the small diameter portion.

* * * * *